US011946355B2

(12) United States Patent
Lourenco et al.

(10) Patent No.: US 11,946,355 B2
(45) Date of Patent: Apr. 2, 2024

(54) METHOD TO RECOVER AND PROCESS METHANE AND CONDENSATES FROM FLARE GAS SYSTEMS

(71) Applicants: 1304338 Alberta Ltd., Edmonton (CA); 1304342 Alberta Ltd., Edmonton (CA)

(72) Inventors: Jose Lourenco, Edmonton (CA); MacKenzie Millar, Edmonton (CA)

(73) Assignees: 1304338 Alberta Ltd., Edmonton (CA); 1304342 Alberta Ltd., Edmonton (CA)

( * ) Notice: Subject to any disclaimer, the term of this patent is extended or adjusted under 35 U.S.C. 154(b) by 337 days.

(21) Appl. No.: 16/764,078

(22) PCT Filed: Nov. 27, 2017

(86) PCT No.: PCT/CA2017/051426

§ 371 (c)(1),
(2) Date: May 14, 2020

(87) PCT Pub. No.: WO2019/095031

PCT Pub. Date: May 23, 2019

(65) Prior Publication Data

US 2020/0386090 A1 Dec. 10, 2020

Related U.S. Application Data

(60) Provisional application No. 62/585,856, filed on Nov. 14, 2017.

(51) Int. Cl.
*F25J 3/02* (2006.01)
*E21B 43/34* (2006.01)

(52) U.S. Cl.
CPC ..... *E21B 43/34* (2013.01); *F25J 3/0209* (2013.01); *F25J 3/0238* (2013.01); *F25J 2200/02* (2013.01); *F25J 2200/78* (2013.01); *F25J 2205/04* (2013.01); *F25J 2205/40* (2013.01); *F25J 2205/50* (2013.01); *F25J 2205/80* (2013.01); *F25J 2215/04* (2013.01); *F25J 2220/66* (2013.01); *F25J 2220/68* (2013.01);

(Continued)

(58) Field of Classification Search
CPC ..... F25J 3/0209; F25J 3/0238; F25J 3/0233; F25J 3/0219; F25J 3/0266; F25J 2205/04; F25J 2205/40; F25J 2205/50; F25J 2205/80; F25J 2200/02; F25J 2200/78; E21B 43/34
See application file for complete search history.

(56) References Cited

U.S. PATENT DOCUMENTS 4,419,114 A 12/1983 May et al.
6,094,937 A 8/2000 Paurola et al.
(Continued)

FOREIGN PATENT DOCUMENTS

CA 2552865 C 5/2016
WO 2005114076 A1 12/2005

*Primary Examiner* — Frantz F Jules
*Assistant Examiner* — Webeshet Mengesha
(74) *Attorney, Agent, or Firm* — CHRISTENSEN O'CONNOR JOHNSON KINDNESS PLLC

(57) ABSTRACT

A method to recover and process hydrocarbons from a gas flare system to produce natural gas liquids (NGL), cold compressed natural gas (CCNG), compressed natural gas (CNG) and liquid natural gas (LNG). The method process provides the energy required to recover and process the hydrocarbon gas stream through compression and expansion of the various streams.

16 Claims, 5 Drawing Sheets

(52) U.S. Cl.
CPC ..... *F25J 2230/30* (2013.01); *F25J 2240/02* (2013.01); *F25J 2240/30* (2013.01); *F25J 2270/04* (2013.01)

(56) References Cited

U.S. PATENT DOCUMENTS

| | | | | |
|---|---|---|---|---|
| 8,429,932 | B2 | 4/2013 | Lourenco et al. | |
| 8,640,494 | B2 | 2/2014 | Lourenco et al. | |
| 10,006,695 | B2 | 6/2018 | Millar et al. | |
| 10,077,937 | B2 | 9/2018 | Millar et al. | |
| 10,288,347 | B2 | 5/2019 | Lourenco et al. | |
| 10,634,426 | B2 | 4/2020 | Lourenco et al. | |
| 10,852,058 | B2 | 12/2020 | Millar et al. | |
| 11,097,220 | B2 | 8/2021 | Lourenco et al. | |
| 11,173,445 | B2 | 11/2021 | Lourenco et al. | |
| 11,486,636 | B2 | 11/2022 | Lourenco et al. | |
| 2006/0196226 | A1 | 9/2006 | Bencze et al. | |
| 2008/0190025 | A1 | 8/2008 | Stinson | |
| 2010/0242499 | A1 | 9/2010 | Lourenco et al. | |
| 2012/0186296 | A1* | 7/2012 | Gnanendran | C10L 3/104 62/637 |
| 2013/0152627 | A1* | 6/2013 | Lourenco | F25J 3/0209 62/611 |
| 2013/0333416 | A1 | 12/2013 | Lourenco et al. | |
| 2014/0182331 | A1 | 7/2014 | Burmberger et al. | |
| 2014/0366577 | A1 | 12/2014 | Zubrin et al. | |
| 2015/0345858 | A1* | 12/2015 | Millar | F25J 1/0201 62/613 |
| 2015/0376512 | A1* | 12/2015 | Lourenco | C10G 47/26 422/162 |
| 2016/0061519 | A1* | 3/2016 | Millar | F25J 3/0209 62/612 |
| 2016/0238314 | A1 | 8/2016 | Millar et al. | |
| 2017/0241709 | A1* | 8/2017 | Lourenco | F25J 1/004 |
| 2020/0386475 | A1 | 12/2020 | Lourenco et al. | |

* cited by examiner

METHOD TO RECOVER AND PROCESS METHANE AND CONDENSATES FROM FLARE GAS SYSTEMS

FIELD

This relates to a method that recovers and processes methane and condensates from flare gas systems and allows it to be transported economically. The method recovers and processes hydrocarbons from a gas flare system to produce natural gas liquids (NGL), cold compressed natural gas (CCNG), compressed natural gas (CNG) and liquid natural gas (LNG) in proportions dictated by economic considerations.

BACKGROUND

New drilling and fracking processes have substantially increased oil production. A by-product of oil production is associated gas. Where gas transmission pipelines are near these oil production wells, the volume and quality of the co-produced associated gas dictates whether to process and compress to these transmission gas pipelines or simply to flare it. In cases where transmission gas pipelines are not readily available or do not have additional capacity, oil producers simply flare it. Presently, due to increased awareness and concern about greenhouse gas (GHG) emissions and the impact in climate change, governments are implementing new regulations to limit the production and release of hydrocarbon derived GHG emissions. Oil producers who fail to comply are penalized at a cost per a tonne of GHG emissions produced over their allowable limit. The purpose of the penalty is to provide an incentive for oil producers to recover, use, and/or sell these flared hydrocarbon gases. There are various processes available that recover hydrocarbon flare gas, however the capital and operating costs of these processes are normally higher than paying the penalty and hence the option of flaring continues. There is a need for a process that allows producers to profit more from the recovery of these hydrocarbon gases compared to the cost of simply flaring it.

SUMMARY

According to an aspect, there is provided a method that permits the $C_2^+$ fractions of co-produced gas from an oil production facility to be recovered and processed, making them available as value added products. In addition, the $C_2^-$ fraction may be recovered as liquid natural gas (LNG), cold compressed natural gas (CCNG) and/or compressed natural gas (CNG). As will be discussed, the process may be used to achieve a higher recovery of associated gas co-produced from an oil production facility economically, both in capital and operating costs.

According to an aspect, there is provided a method to recover, process and condense hydrocarbons gases co-produced at oil production facilities. First, a pressurized hydrocarbon gaseous stream is treated with methanol to remove its water fraction. Second, the hydrocarbon gaseous stream is pre-cooled to condense and remove the heavier hydrocarbon fractions. Third, the gaseous fraction is split into two streams, a Natural Gas Liquids (NGL) recovery stream and a Liquified Natural Gas (LNG) feed stream. The NGL recovery stream is then partially depressurized through an expander, cooling and feeding the gas into a fractionation unit where the gas is stripped from its condensates to recover the $C_2^+$ fractions in the gas stream. The LNG feed stream is further cooled, and the produced condensates are separated and depressurized through a JT valve as a reflux stream into the fractionation unit. The gaseous LNG feed stream is then processed in a stripping column to remove the $CO_2$ fraction by contact in a countercurrent flow with refrigerated methanol. The $CO_2$ stripped LNG feed stream is further cooled in a heat exchanger by a cryogenic gaseous stream from the LNG receiver. The LNG feed stream produced condensate fraction is separated and streamed to the fractionator through a JT valve as a reflux stream. The gaseous processed LNG feed stream is depressurized through a gas expander into a receiver to produce LNG and a cryogenic gaseous stream. The produced LNG is pumped to storage. The cryogenic gaseous stream is warmed in counter current heat exchangers, compressed and cooled to produce Cold Compressed Natural Gas (CCNG). The lean overhead gas from the fractionator is warmed up in counter-current heat exchangers and compressed to produce Compressed Natural Gas (CNG). The fractionator bottoms, the $C_2^+$ fractions (NGL's) are recovered and pumped to storage.

A feature of the proposed method is the ability to process a gaseous stream that normally is being flared into valuable and transportable hydrocarbons. A second feature of the process is the use of methanol to remove water and CO2 fractions from the feed gas at two distinct operating conditions to meet LNG product specifications. To strip and remove the $CO_2$ fraction from the feed gas in preparation to produce LNG, the methanol must be refrigerated. The refrigeration energy required in the process is provided by heat exchange and recovery of the coolth energy produced by the depressurization of the process gaseous streams. The process can meet various modes of operation to produce; Natural Gas Liquids (NGL's), Cold Compressed Natural Gas (CCNG), Liquid Natural Gas (LNG) and Compressed Natural Gas (CNG). A mixture of lean natural gas and stripped $CO_2$ rich gas provides fuel gas to a power plant to meet electrical load demand of the process rotating equipment (pumps and compressors), thus allowing for a stand-alone mode of operation.

In one aspect, the present method is a process that recovers and processes hydrocarbons gases co-produced at oil production facilities. One feature of the method is the ability to operate under varying flow rates, feed compositions and pressures. Fuel gas streams co-produced at oil production facilities are variable since they are fed from multiple wells. The inventive process can meet any process flow variations, which are not uncommon at oil production facilities gas systems. The process is not dependent on a refrigeration plant size and or equipment as employed in conventional LPG recovery processes.

The process refrigeration requirements are provided by controlling the plant inlet gas pressure and its subsequent heat exchange and pressure drops.

Another benefit of the inventive process is the use of methanol to remove both the water and carbon dioxide from the inlet gas feed stream at two different and distinct methanol operating conditions; warm and refrigerated methanol.

As will hereinafter be described, the above method can operate at any oil production facilities or wells where hydrocarbon gases are produced.

The above described method was developed with a view to recover and process into various products hydrocarbon gases co-produced at oil production facilities.

According there is provided a process, which includes compressing and cooling a produced gas stream to ambient temperature, add and mix methanol at a controlled dosage to remove the feed gas water fraction. Pre-cool, separate and remove the water fraction. Further cool and separate hydrocarbon condensates, split the gaseous stream into a fractionation stream and LNG production stream. Expand and fractionate the fractionation stream. Further cool the LNG production stream and route produced hydrocarbon condensates to fractionator. Strip the $CO_2$ from the gaseous LNG feed stream, cool it further, separate produced hydrocarbon condensates and route it to the fractionator, route the LNG processed gaseous feed stream to a gas expander to depressurize condense and produce LNG. The cryogenic gaseous stream from the LNG receiver is recovered to produce CCNG. The fractionator overhead stream (lean natural gas) is compressed to produce CNG. A portion of the lean gas is mixed with a $CO_2$ rich gas to provide fuel to a power generation plant.

According to an aspect, there is provided a method to recover and process hydrocarbons from a gas flare system to produce natural gas liquids (NGLs), cold compressed natural gas (CCNG), compressed natural gas (CNG) and liquid natural gas (LNG), the method comprising the steps of: providing a compressor to meet the feed gas pressure requirements into the plant; providing heat exchangers to provide the thermal energy required for the regenerator and fractionator bottoms reboiler streams; providing a heat exchanger to provide the thermal energy required for a methanol regenerator bottoms reboiler stream; providing an in-line gas mixer for methanol addition; providing a heat exchanger to provide the thermal energy required for a fractionator bottoms reboiler stream; providing a separator to recover the methanol/water mixture; providing a solvent recovery membrane system for methanol recovery; providing heat exchangers in series to recover cold thermal energy; providing a separator to separate the gaseous hydrocarbon fraction from the produced condensates; providing a gas expander to generate shaft power and cryogenic temperatures; providing a gas fractionator column to produce a gaseous lean gas stream and a liquid mixture of hydrocarbons; providing heat exchangers to recover cold thermal energy from a fractionator overhead stream; providing a separator to separate the gaseous hydrocarbon fraction from the produced condensates; providing a secondary reflux stream from produced and recovered condensates; providing a CO2 stripping column employing refrigerated methanol as the CO2 stripping agent; providing a CO2 regeneration unit; providing an heat exchangers by-pass control system to refrigerate methanol; providing a separator to separate the gaseous hydrocarbon fraction from the produced condensates; providing a primary reflux stream from produced and recovered condensates; providing a second gas expander to generate shaft power and cryogenic temperatures; providing a separator to separate a cryogenic gaseous stream from produced LNG; providing heat exchangers to recover cold thermal energy from a cryogenic overhead stream of an LNG separator; providing an heat exchangers by-pass control system to refrigerate methanol; providing heat exchangers to refrigerate methanol; providing heat exchangers to produce CCNG; providing compressors to produce CNG; and providing a fuel gas stream to power an auxiliary power plant.

According to other aspects, the method may comprise one or more of the following aspects, alone or in combination: the heat requirements for the methanol regenerator and gas fractionator may be provided by heat generated in an input compressor; the heat requirements for the methanol regenerator and gas fractionator provided by heat generated in an input compressor may be temperature controlled by an air heat exchanger; methanol may be used to dry the feed gas; the methanol may be separated from the water in a solvent membrane unit; high pressure recovered condensate may be employed as a secondary reflux to the fractionator; methanol may be refrigerated by recovered cold thermal energy and used to strip CO2 from a cold, high pressure natural gas stream; the refrigerated methanol operating temperature may be provided and controlled from a cryogenic gaseous stream from an LNG separator; LNG may be processed and produced without an external source of refrigeration energy; CCNG may be produced by recovering its own cold thermal energy; and the C2+ fractions in the gas feed stream may be recovered and fractionated.

According to another aspect, there is provided a method to recover and process hydrocarbons from a gas flare system to produce natural gas liquids (NGLs), cold compressed natural gas (CCNG), compressed natural gas (CNG) and liquid natural gas (LNG), the method comprising the steps of: capturing associated gas produced from a wellhead, the associated gas comprising at least methane and natural gas liquids (NGLs) in vapor form; compressing the associated gas to produce a pressurized natural gas stream; passing the pressurized natural gas stream through a dewatering unit to remove at least a portion of the water; cooling the pressurized natural gas stream to produce a cooled rich natural gas stream in which at least a portion of the NGLs are condensed; separating the cooled rich natural gas stream into a lean natural gas stream and an NGL stream; processing the lean natural gas stream to produce a fuel gas stream, a compressed natural gas (CNG) stream, a cold compressed natural gas (CCNG) stream, and a liquid natural gas (LNG) stream, wherein: the fuel gas stream is produced by conditioning a portion of the lean natural gas stream to a pressure and temperature suitable for use by a power plant; the CNG stream is produced by compressing a portion of the lean natural gas stream to a pressure greater than the fuel gas stream; and the LNG stream and the CCNG stream are produced by: passing a portion of the lean natural gas stream through a carbon dioxide stripping unit to produce a stripped gas stream; expanding the stripped gas stream to achieve cryogenic temperatures sufficient to condense a portion of the stripped gas stream, and passing the cooled, condensed stripped gas stream to obtain the LNG stream and a cold natural gas stream; and compressing the cold natural gas stream to produce the CCNG stream.

According to other aspects, the method may comprise one or more of the following aspects, alone or in combination: the fuel gas stream and the compressed natural gas stream may each be generated from an overhead stream of a fractionation tower; the fractionation tower may comprise a reboiler stream heated by a heat exchanger; the fractionation tower may be fed by one or more reflux streams diverted from the LNG generation process; at least a portion of the NGLs may be recovered from a bottoms stream of the fractionation tower; the dewatering unit may comprise an inline mixer for mixing the pressurized natural gas stream with methanol as a dewatering agent; the methanol may pass through a methanol regenerator column; the methanol regenerator column may comprise a reboiler stream heated in a heat exchanger by the pressurized natural gas stream; the dewatering unit may comprise an inline mixer for mixing methanol with the pressurized natural gas stream, and a separator downstream of the inline mixer for removing a methanol/water mixture from the pressurized natural gas stream; expanding the stripped gas stream to achieve cryogenic temperatures may comprise using a gas expander to generate power; the carbon dioxide stripping unit may mix refrigerated methanol with the portion of the lean natural gas stream in a countercurrent vessel; the LNG stream may be produced exclusively by cold temperatures obtained by expanding gas streams in the production of at least one of the CNG, CCNG, and LNG streams; the CCNG stream may be produced by recovering its own cold thermal energy in a heat exchanger.

BRIEF DESCRIPTION OF THE PROCESS DRAWING

These and other features will become more apparent from the following description in which reference is made to the appended drawing, the drawing is for the purpose of illustration only and is not intended to in any way limit the scope of the invention to the particular embodiment or embodiments shown, wherein.

DETAILED DESCRIPTION OF THE PREFERRED EMBODIMENT

Figure 3:
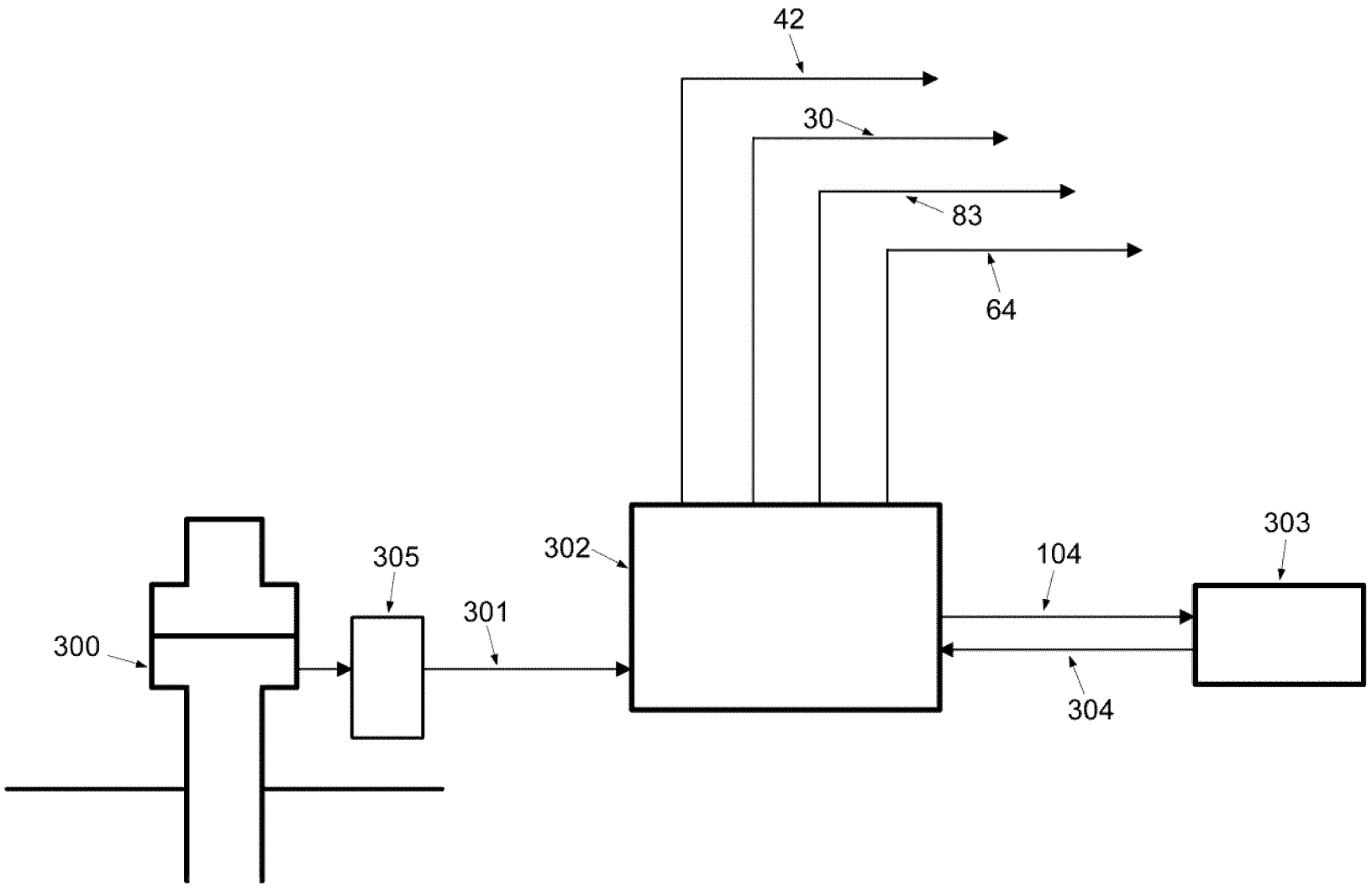
FIG. 3 is a schematic diagram of a well site.

The method will now be described with reference to FIGS. 1A, 1B, and 3.

The method was developed with a view for recovery and processing of hydrocarbon gaseous fractions co-produced at oil production facilities. The description of application of the method should, therefore, be considered as an example and not limited to oil production facilities but also to where gaseous hydrocarbon streams are available. Referring to FIG. 3, as an example, there is shown a wellhead 300 that produces primarily liquid hydrocarbons as well as associated gas. The production fluids exiting the wellhead may include liquid hydrocarbons, water, sand, gas, etc., and the associated gas is separated from the production fluids using separation equipment 305. The associated gas is transferred to the process equipment 302 described below through line 301. Process equipment 302 is used to produce liquid natural gas (LNG) in stream 64, cold compressed natural gas (CCNG) in stream 83, natural gas liquids (NGLs) in stream 30, compressed natural gas (CNG) in stream 42, and a fuel gas stream 104 that is used as fuel for a power plant 303. Power plant 303 provides the necessary power to equipment 302. The transfer of power is represented by line 304, and may include electrical, mechanical, hydraulic, etc.

As will be understood from the description below, process equipment 302 may be modified to adjust the relative amounts, as well as the pressure and temperature conditions, of each product listed above. When gas pipeline infrastructure is not available, it is often not economical to capture and transport associated gas to a sales facility. By varying the proportion and conditions of the products, the likelihood of the products being able to be transported economically is greatly increased. For example, if natural gas is to be transported by tank, the volume of the tank is fixed, however the mass of the natural gas, which determines the actual value, will vary depending on the density of the fluid. By increasing the pressure and decreasing the temperature, the density can be increased. The additional costs associated with transporting the gas greater distances can be offset by increasing the mass being transported by the tank.

Figure 1A:
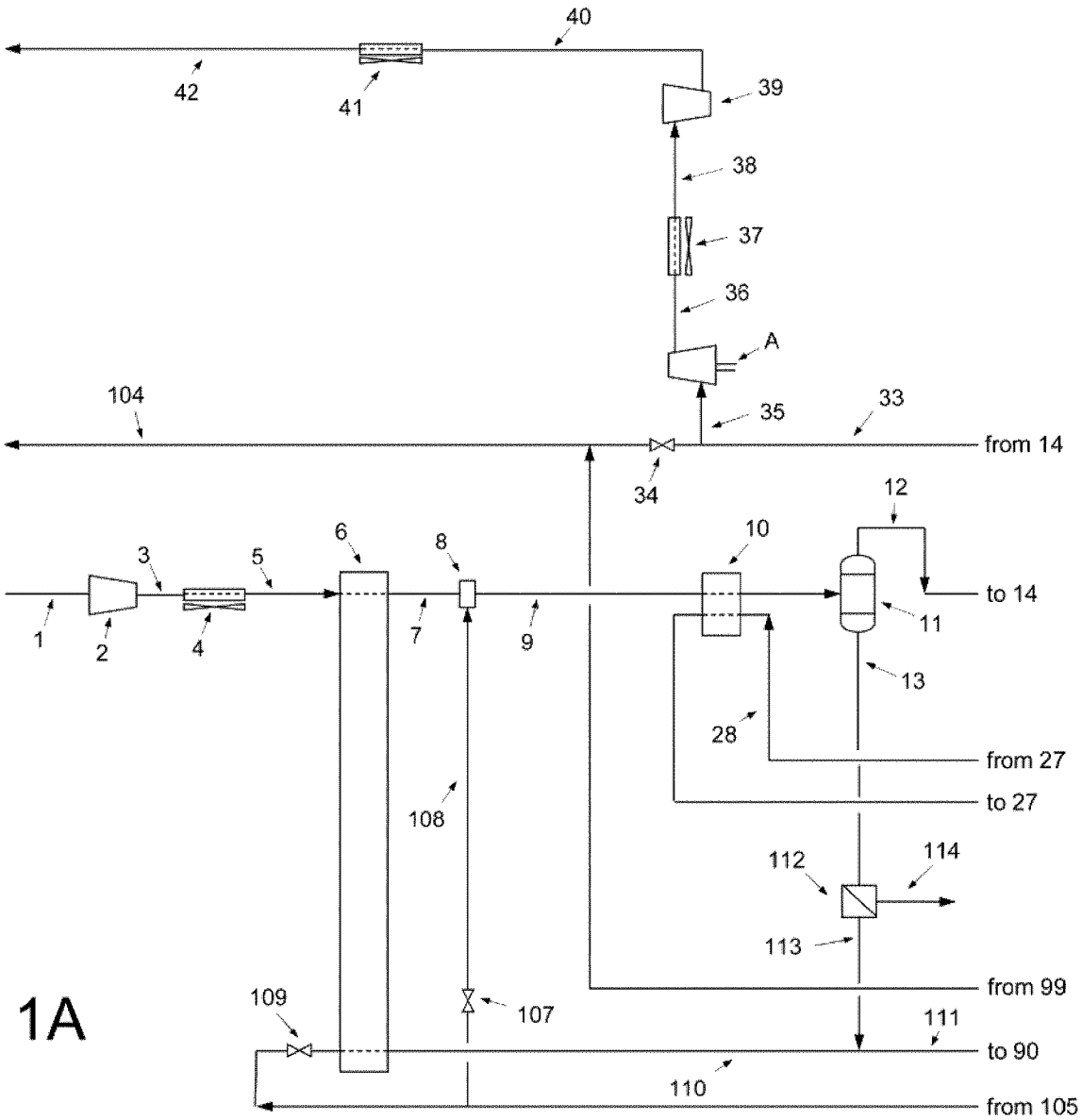
FIGS. 1A and 1B is a schematic diagram of a process used to recover and process hydrocarbon gases co-produced at oil production facilities equipped with compressors, heat exchangers, an in-line mixer, separators, pumps, a fractionator, a stripper and a regenerator.
Figure 1B:
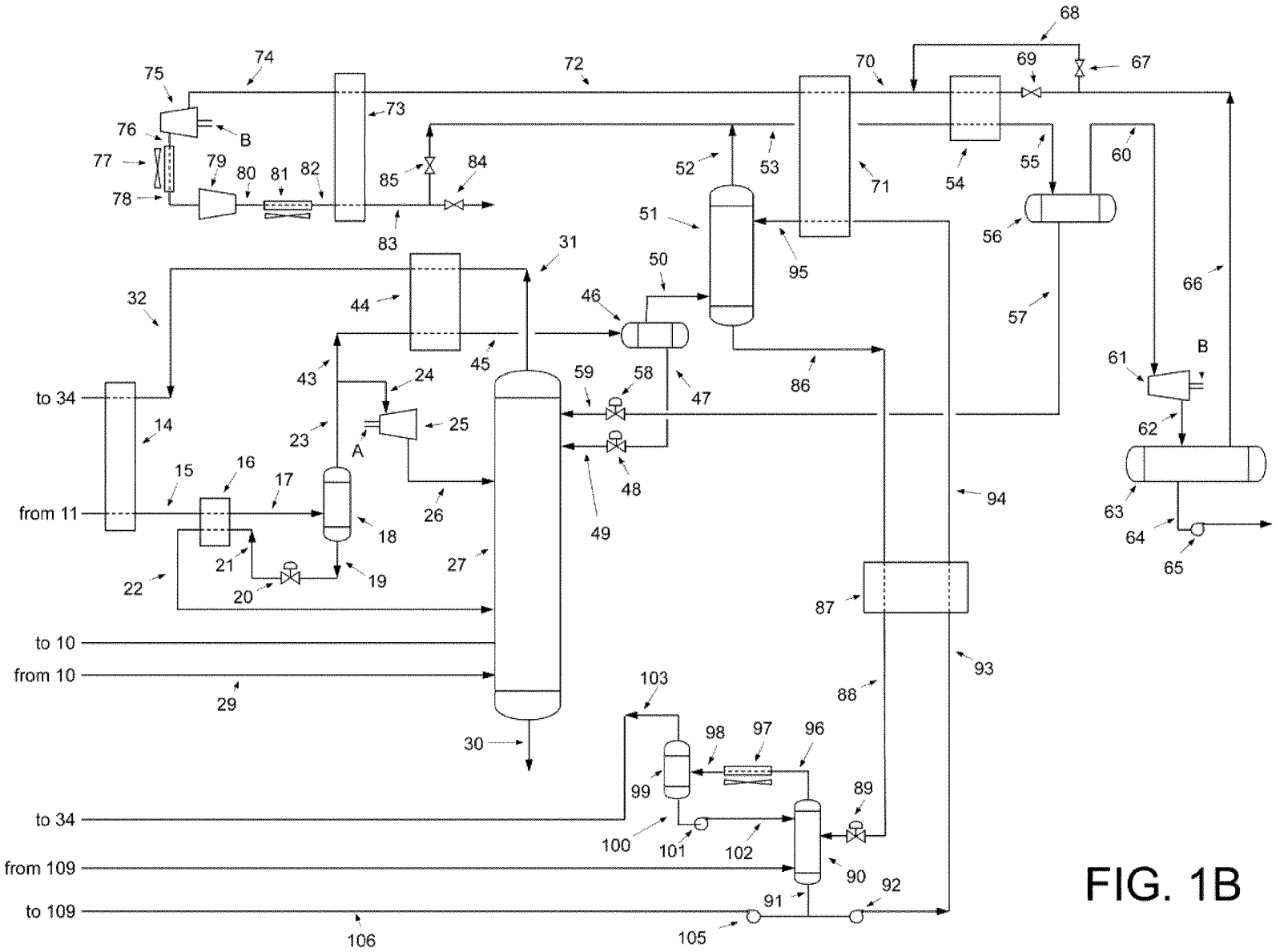

Referring to FIGS. 1A and 1B, a hydrocarbon feed gas stream 1 is compressed by compressor 2 to a pressure greater than 500 psig. The compressed stream 3 cooled to a temperature controlled fin-fan air heat exchanger 4. This temperature is controlled to meet the reboiler temperatures of heat exchangers 6 and 10. The temperature controlled hydrocarbon feed gas stream 5 flows through heat exchanger 6 where it gives up some of its heat to the methanol reboiler stream 106, the cooler hydrocarbon feed gas stream 7 flows through in-line mixer 8 where methanol stream 108 is added and mixed as required to absorb the water fraction in hydrocarbon gas stream 7. The mixed stream 9 is further cooled in heat exchanger 10 before discharging into separator 11, where condensates, mainly water and methanol are separated and removed through line 13. The condensed liquid fraction stream 13 enters a membrane unit 112 where the water is separated from the methanol and removed through line 114. The dewatered hydrocarbon feed gas stream 12 is further cooled in heat exchanger 14 and stream 15 is further cooled in heat exchanger 16 before entering liquids hydrocarbon separator 18. The hydrocarbon liquid fraction exits separator 18 through stream 19, and the pressure of stream 19 is reduced at TT valve 20 to meet the operating pressure of fractionator 27 operating pressure. As a result of this pressure reduction, stream 21 is colder and gives up its cold energy to stream 15 in heat exchanger 16. The now warmer stream 22 is routed to fractionator 27.

The hydrocarbon gaseous fraction exits separator 18 through stream 23 and is split into two streams, fractionator stream 24 and LNG feed stream 43. The fractionator stream 24 of gaseous hydrocarbons enters an expander 25 where the pressure is reduced to the operating pressure of fractionator 27. The cooled stream 26 exits expander 25 and enters fractionator 27. The LNG feed stream 43 is further cooled in heat exchanger 44, and the cooled stream 45 enters separator 46 to remove any condensed hydrocarbons. The condensed fraction exits separator 46 through line 47 and the pressure is reduced at a JT valve 48 to the operating pressure of fractionator 27 to produce a cooled stream 49 that enters the fractionator 27 as a secondary reflux stream.

The gaseous LNG feed stream exits separator 46 through line 50 into carbon dioxide stripper 51. The carbon dioxide stripped gaseous LNG feed stream 52 enters line 53 and is further cooled in heat exchanger 54 before entering separator 56 through line 55. The condensed and separated liquid fraction is routed through line 57 and its pressure is reduced at JT valve 58 to the operating pressure of fractionator 27. The colder, de-pressured stream 59 enters fractionator 27 as a primary reflux stream. The gaseous LNG feed stream exits separator 60 and is expanded through gas expander 61 to a separator 63 operating pressure, which is preferably greater than 1 psig. The produced LNG exits separator 63 through line 64 and pumped to storage through pump 65. The gaseous cryogenic fraction exits LNG separator 63 through line 66 and enters heat exchanger 54 through valve 69. A bypass stream 68 around heat exchanger 54 is controlled by valve 67, which allows the temperature of the methanol stream 94 to be controlled by heat exchanger 71. The cryogenic gaseous stream 70 is further heated in heat exchanger 71 to a warmer gaseous stream 72 which is further warmed in heat exchanger 73. The warmed gas stream 74 is compressed in booster compressor 75, which is coupled to expander 61 by shaft B. The compressed gas stream 76 is air cooled in air cooled fan 77 and further compressed in compressor 79. The compressed gas stream 80 is cooled by air in fin fan cooler 81 and line 82 is further cooled in heat exchanger 73. The cold compressed gas in line 82 can be sent to storage or distribution through valve 84 and/or recycled through valve 85 to line 53.

The CO2 stripper is a major feature of the proposed process since it uses refrigerated methanol to remove CO2 from the LNG feed gas stream to meet LNG product CO2 spec of less than 50 ppmv. Regenerated methanol stream 91 is pressurized by pump 92 to the operating pressure of CO2 stripper column 51. The pressurized methanol stream 93 is first cooled in heat exchanger 87, and the cooled stream 94 is further cooled in heat exchanger 71 before entering CO2 stripper column 51. The temperature of the refrigerated methanol in line 95 as it enters stripping column 51 is controlled by controlling the temperature of stream 70 into heat exchanger 71. In stripping column 51, the temperature controlled refrigerated methanol flows downwards in a counter-current flow relative to the LNG feed gas stream that enters stripper column 51 through line 50, such that the methanol strips and absorbs the CO2 from the gaseous stream as it flows upwards through stripping column 51. The CO2 rich methanol stream 86 exits stripping column 51 via line 86 and enters heat exchanger 87 where it cools methanol stream 93. The heated, rich CO2 methanol stream 88 is depressurized through valve 89 and enters methanol regenerator column 90, where the CO2 is separated from the methanol.

A slipstream of the lean methanol stream 91 is routed to methanol pump 105, and the pressurized methanol stream 106 is split into a reboiler stream and an absorbent stream. The reboiler stream flow is controlled through valve 109 and gains heat in heat exchanger 6. The temperature requirement for heat transfer in heat exchanger 6 is controlled by controlling the temperature of feed gas stream 5. The heated methanol stream 110 is mixed with recovered methanol stream 113 and is routed through line 111 to the methanol regenerator to control the column bottoms operations temperature in regenerator column 90.

The absorbent methanol stream is flow-controlled through valve 107 and routed through line 108 to feed gas mixer 8. The rate of methanol flow is controlled to meet the methanol required to absorb the water in the feed gas stream. The recovered mixture of methanol and water exits separator 11 through line 13 and is routed to a solvent membrane unit 112 to separate the water from the methanol and to recover the methanol. The recovered methanol is routed through line 113 into reboiler stream 110. The separated water fraction is removed from solvent membrane unit 112 for disposal through line 114.

The overhead stream 96 of methanol regeneration column 90 is cooled by an air heat exchanger 97, and the cooled stream 98 enters separator 99 where the condensed liquid fraction 100 is pressurized by pump 101 and routed through line 102 as a reflux stream to regenerator column 90. The gaseous fraction 103 exits separator 99 and flows into fuel gas line 104 where it is mixed with hydrocarbon gas supplied from valve 34 to meet plant fuel gas requirements.

The fractionated lean gas stream 31 exits fractionator 27 and is first heated in heat exchanger 44, and the heated lean gas stream 32 is further heated in heat exchanger 14. The heated lean gas stream 33 is split into two streams, a fuel gas stream 104 and a compressed natural gas stream 35. The fuel gas stream 104 is controlled by valve 34 to meet the fuel needs of the plant. The pressure of natural gas stream 35 is first boosted by a compressor coupled by shaft A to expander 25. The compressed lean gas stream 36 is cooled by air heat exchanger 37 and the cooled lean gas stream is further compressed by compressor 39 and discharged through line 40 into air cooled heat exchanger 41 and routed through line 42 to distribution and/or storage as compressed lean natural gas.

The objective of the described process is to recover and process hydrocarbon gas streams at oil production fields that are typically combusted in flares. The many features of the process are the processing and production of four or more distinct products from a resource typically wasted by combustion in a flare, the products of combustion and its thermal heat are released into the atmosphere.

The electrical and thermal energy needs required for the process are provided by an auxiliary power plant (not shown) fuelled from a recovered fuel gas stream, such as fuel stream 104 shown in FIGS. 1A and 1B. The proposed process unlike other standard processes provides in a single plant the ability to produce LNG, CCNG, CNG, NGL's and fuel gas for an auxiliary power plant.

The definitions of LNG, CCNG, and CNG, which are primarily made from methane with a minimal amount of heavier hydrocarbons, are well known in the art. Each of these products is conditioned to increase the density to different decrees in order to allow a greater mass to be transported in the same volume. Briefly, LNG is produced at cryogenic temperatures, or temperatures around 160° C., although the conditions necessary to produce LNG will depend on various factors, including the pressure, composition, etc. CNG is generally around ambient temperatures, and at pressures of up to 3,600 psi. The pressure range may vary depending on the intended use, or required level of density. In some circumstances, the pressure will vary based on the requirements of the system for example the pressure may be as low as 800-1200 psi for a gas transmission pipeline, around 80 psi for a distribution pipeline, around 25 psi for a residential system, etc. CCNG is achieved by pressurising and cooling natural gas to temperatures that are less than 0° C., and may be as low as −100° C. or lower, depending on the desired product characteristics and limits based on available equipment. CCNG may be pressurized and cooled to its critical point (i.e. about −83° C. and 676 psi for methane).

One main feature of the method is the flexibility of the process to meet various process operating conditions to meet product demand. The proportion of products and the density of each product can be varied based on economic considerations, such as the demand for the product, the price of the product, the cost of transportation, the distance to be traveled, etc. The method also provides for a significant savings in GHG emissions when compared to the current practice of flaring. The proposed method can be applied at any plant where hydrocarbons gases require processing.

Figure 2A:
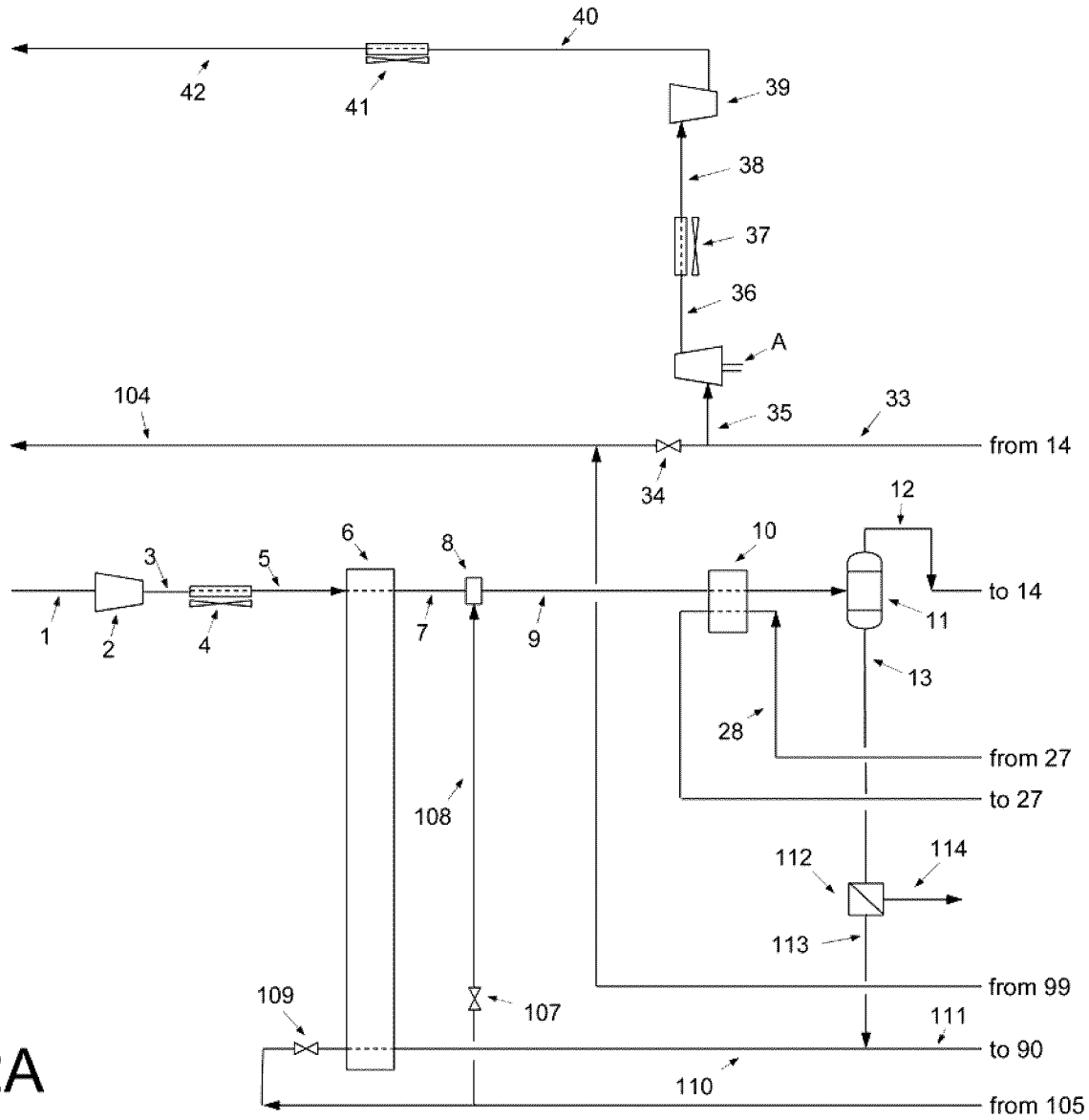
FIGS. 2A and 2B is a schematic diagram of an alternative to the process depicted in FIGS. 1A and 1B
Figure 2B:
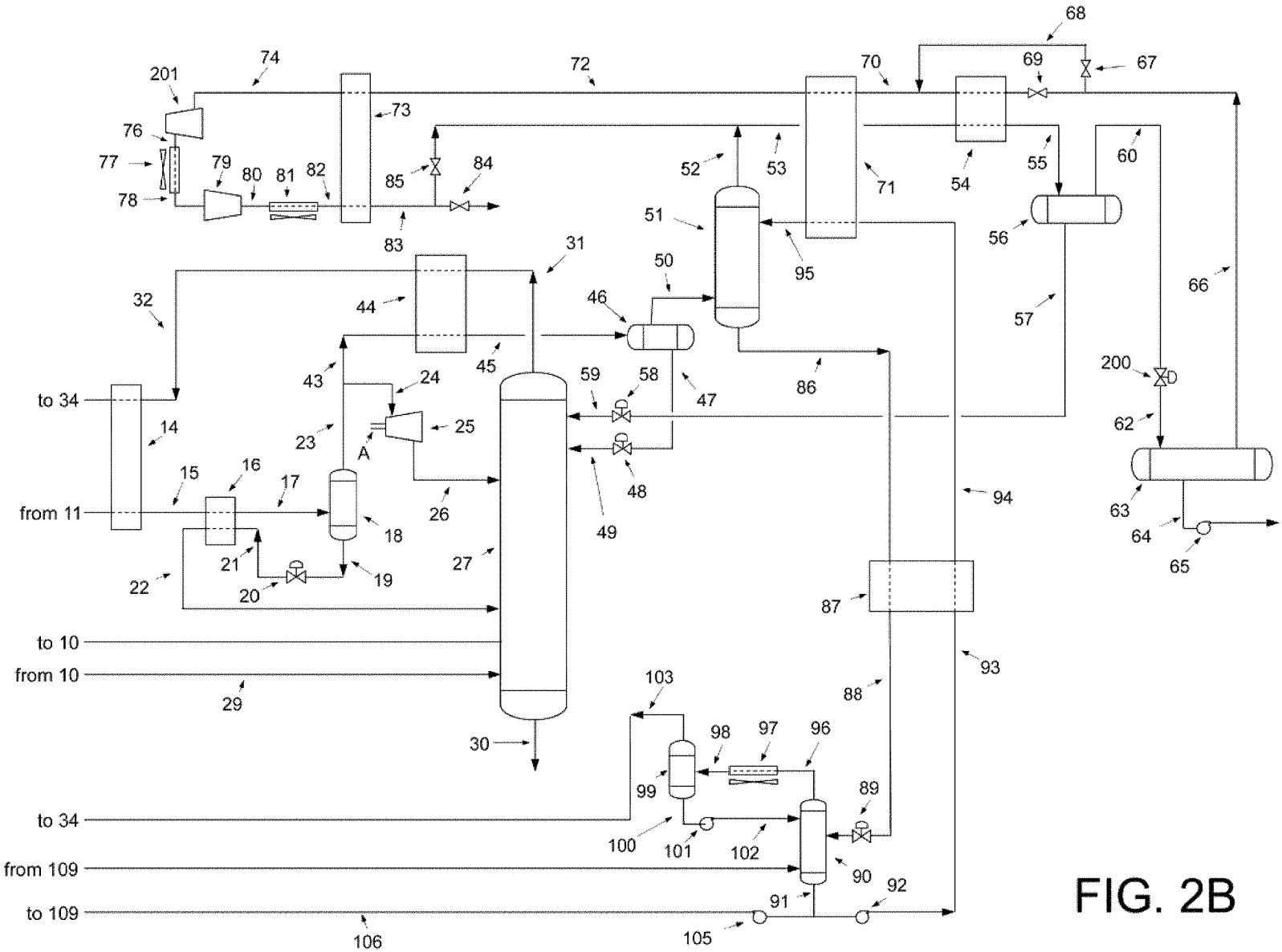

FIGS. 2A and 2B show a variation, in which gas expander 61 shown in FIGS. 1A and 1B has been replaced by a JT valve 200, and expander 75 by a stand-alone compressor 201. The process configuration of FIGS. 2A and 2B may be used when less LNG is required to be produced, while increasing CCNG production.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method to recover and process associated gas from an oil-producing well to produce natural gas liquids (NGLs), cold compressed natural gas (CCNG), compressed natural gas (CNG) and liquid natural gas (LNG), the method comprising the steps of:

capturing associated gas produced from a wellhead, the associated gas comprising at least methane, water, and natural gas liquids (NGLs) in vapor form;

compressing the associated gas to produce a pressurized natural gas stream;

passing the pressurized natural gas stream through a dewatering unit to remove at least a portion of the water;

cooling the pressurized natural gas stream to produce a cooled rich natural gas stream in which at least a portion of the NGLs are condensed;

separating the cooled rich natural gas stream into a gaseous natural gas stream and an NGL stream;

processing the gaseous natural gas stream to produce a fuel gas stream, a compressed natural gas (CNG) stream, a cold compressed natural gas (CCNG) stream, and a liquid natural gas (LNG) stream, wherein:

producing the LNG stream comprises passing a portion of the gaseous natural gas stream through a carbon dioxide stripping unit to produce a stripped feed stream;

the fuel gas stream comprises a fuel gas portion of the gaseous natural gas stream that is conditioned to a pressure and temperature suitable for use by a power plant;

the CNG stream comprises a CNG portion of the gaseous natural gas stream that is compressed to a pressure greater than the fuel gas stream; and the LNG stream and the CCNG stream are produced by:

producing a partially condensed stripped gas stream by expanding the stripped feed stream from the carbon dioxide stripping unit to achieve cryogenic temperatures, and passing the partially condensed stripped gas stream through a separator to obtain the LNG stream and a cold natural gas stream; and compressing the cold natural gas stream to produce the CCNG stream.

2. The method of claim 1, wherein the fuel gas stream and the CNG stream are each generated from an overhead stream of a fractionation tower.

3. The method of claim 2, wherein the fractionation tower comprises a reboiler stream heated by a heat exchanger.

4. The method of claim 2, wherein the fractionation tower is fed by one or more reflux streams diverted from the LNG stream.

5. The method of claim 2, wherein at least a portion of the NGLs are recovered from a bottoms stream of the fractionation tower.

6. The method of claim 1, wherein the dewatering unit comprises an inline mixer for mixing the pressurized natural gas stream with methanol as a dewatering agent.

7. The method of claim 6, wherein the methanol passes through a methanol regenerator column.

8. The method of claim 7, wherein the methanol regenerator column comprises a reboiler stream heated in a heat exchanger by the pressurized natural gas stream.

9. The method of claim 1, wherein the dewatering unit comprises an inline mixer for mixing methanol with the pressurized natural gas stream, and a separator downstream of the inline mixer for removing a methanol/water mixture from the pressurized natural gas stream.

10. The method of claim 1, wherein expanding the stripped gas stream to achieve cryogenic temperatures comprises using a gas expander to generate power.

11. The method of claim 1, wherein the carbon dioxide stripping unit mixes refrigerated methanol with the at least a portion of the gaseous natural gas stream in a countercurrent vessel.

12. The method of claim 1, wherein the LNG stream is produced exclusively by cold temperatures obtained by expanding gas streams in the production of at least one of the CNG, CCNG, and LNG streams.

13. The method of claim 1, wherein the cold natural gas stream is compressed in a compressor, and the CCNG stream is produced by causing the cold natural gas stream upstream of the compressor to cool the cold natural gas stream downstream of the compressor in a heat exchanger.

14. The method of claim 1, further comprising the steps of identifying potential markets for at least one of the CNG, CCNG, and LNG streams, and adjusting one or more operating parameters to adjust a relative proportion of CNG, CCNG, and LNG streams produced.

15. The method of claim 1, further comprising the steps of identifying potential markets for at least one of the CNG, CCNG, and LNG streams, and adjusting one or more operating parameters to adjust a temperature and pressure of at least one of the CNG, CCNG, and LNG streams.

16. The method of claim 11, wherein at least one of the fuel gas portion of the gaseous natural gas stream and the CNG portion of the lean natural gas stream are derived from a liquid outlet of the countercurrent vessel.

* * * * *